US006193613B1

(12) United States Patent
Alexandres

(10) Patent No.: US 6,193,613 B1
(45) Date of Patent: Feb. 27, 2001

(54) GOLF VENT WITH BALL RETURN

(76) Inventor: Jon K. Alexandres, 420 Prairie View La., Mason City, IA (US) 50401

( * ) Notice: Subject to any disclaimer, the term of this patent is extended or adjusted under 35 U.S.C. 154(b) by 0 days.

(21) Appl. No.: 09/327,269

(22) Filed: Jun. 7, 1999

(51) Int. Cl.[7] ..... A63B 69/36
(52) U.S. Cl. ..... 473/183; 473/178
(58) Field of Search ..... 473/178, 180, 473/181, 182, 184–190, 175, 179, 173, 174, 176, 177, 183; 454/289–291

(56) References Cited

U.S. PATENT DOCUMENTS 3,310,312 * 3/1967 Peeples ..... 473/178
3,897,059 * 7/1975 McCulloch et al. ..... 473/178
4,563,009 * 1/1986 Nagasaki et al. ..... 473/183
5,120,063 6/1992 Birchler .
5,205,559 * 4/1993 Plopper ..... 473/179
5,275,405 1/1994 Ridge .
5,620,375 4/1997 Frotten .
5,997,407 * 12/1999 Alexandres ..... 473/180

* cited by examiner

*Primary Examiner*—Mark S. Graham
(74) *Attorney, Agent, or Firm*—G. Brian Pingel

(57) ABSTRACT

A golf putting practice device adapted to serve as a substitute for a floor vent that fits into a floor duct of a forced air circulation system of a building and includes a cup shaped ball receiving enclosure and at least one flat support plate member extended outwardly from the ball receiving enclosure. A bottom of the receiving enclosure includes a ball return mechanism that ejects a ball from such enclosure. A plurality of apertures are formed in the support plate member to allow for air flow through the plate.

12 Claims, 4 Drawing Sheets

GOLF VENT WITH BALL RETURN

BACKGROUND OF THE INVENTION

1. Field of the Invention

The present invention relates in general to a golf putting practice device and more particularly to such a practice device that fits into the floor duct of a forced air circulation system of a building and has a ball return mechanism.

2. Description of the Prior Art

A wide variety of golf putting practice devices are known in the prior art. Many such devices are designed to sit on the surface of a floor for putting practice and include a ball return mechanism that returns a ball back to the user after a successful putt. Although, such devices are useful for putting practice, they include a ramped sidewall that leads up to a simulated putting cup and, therefore, are not truly representative of putting on a golf green.

To overcome the deficiency of ramped golf practice devices, prior art practice devices have been developed that are adapted to fit into the floor duct of a forced air circulation system of a building such as those disclosed in U.S. Patents to Birchler, et al., U.S. Pat. No. 5,120,063; Ridge, U.S. Pat. No. 5,275,405 and Frotten, U.S. Pat. No. 5,620,375. The golf practice devices disclosed in these patents substantially eliminate the need for a ramped sidewall, but they all are formed from flat support plates that surround a ball receiving portion of the device, which flat plates provide an obstruction to such portion.

To lessen this problem, the Frotten patent discloses a golf practice device fabricated of a resilient material so that the device can be installed in a floor duct by bending the support plate for insertion underneath the carpet surrounding the duct. Although such configuration is an improvement in reducing obstruction to the ball receiving portion, the Frotten practice device cannot readily be moved from one vent to another and depending on the thickness of the carpet under which it is installed, the path to the cup is not completely level. Moreover, none of these in-floor devices include a ball return mechanism.

The present invention is designed to provide a golf putting practice device that overcomes the deficiencies of the foregoing prior art.

SUMMARY OF THE INVENTION

The present invention provides a golf putting practice device adapted to serve as a substitute for a floor vent that fits into a floor duct of a forced air circulation system of a building. The practice device includes a generally cup shaped ball receiving means having a bottom wall and two opposite sidewalls that are each attached to a flat support plate member extended perpendicularly outward from the sidewall upper portions. The bottom wall is associated with a ball return means for ejecting a golf ball from the receiving means.

The front wall of the ball receiving means further includes an upper notched portion that provides a golf ball open access to the receiving means and the plate members include a plurality of apertures for the passage of air therethrough. Preferably, the support plate members are generally equal in size so that the ball receiving means is located medially of the practice device. The support plate members and ball receiving means are sized so that the device generally conforms to the size of the floor duct in which it is to be installed. The support plate members further include a peripheral flange that overlies the circumference of the floor duct to support the device on the floor.

The foregoing and other advantages of the present invention will appear from the following description. In the description, reference is made to the accompanying drawings, which form a part hereof, and in which there is shown by illustration, and not of limitation, a specific form in which the invention may be embodied. Such embodiment does not represent the full scope of the invention, but rather the invention may be employed in a variety of embodiments, and reference is made to the claims herein for interpreting the breadth of the invention.

BRIEF DESCRIPTION OF THE DRAWINGS

FIG. 3 is a perspective view of the putting device of FIG. 1 installed within a floor vent opening.

DETAILED DESCRIPTION OF THE PREFERRED EMBODIMENT

Figure 1:
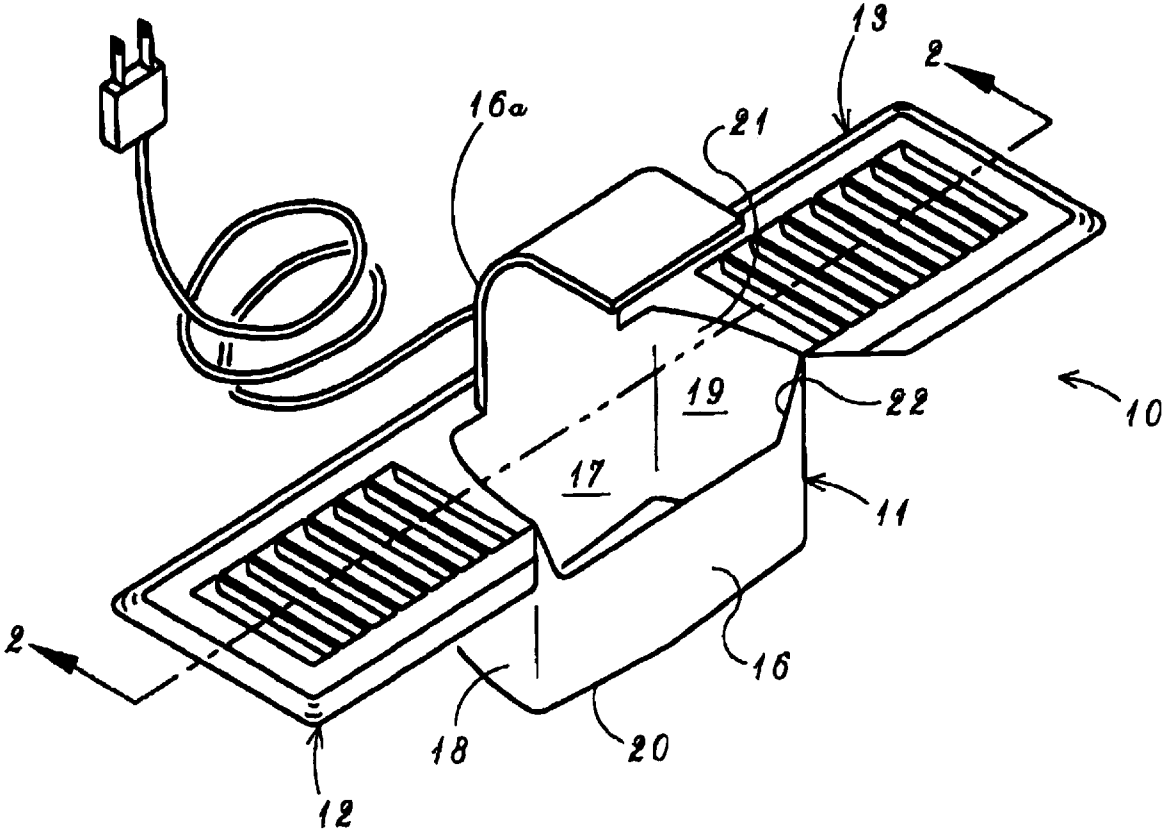
FIG. 1 is a front perspective view of a preferred embodiment of the golf putting practice device of the present invention.

Referring now to the drawings and with reference first to FIG. 1, a golf putting practice device of the present invention is shown at 10 and is adapted to serve as a substitute for a floor vent that fits into a floor duct of a forced air circulation system of a building. The device 10 is preferably integrally formed with a ball receiving means 11 and a pair of generally flat support plate members 12 and 13 that are less than 2 millimeters thick.

Although the device 10 can be formed of plastic, such as in an injection molded process, it has been found that when made of flat sheet steel, the entire device can be manufactured by means of a stamp process that allows for manufacturing and production economies and advantages, and duplicates the production process of most standard floor vents. Of course, one skilled in the art can envision alternate materials of and processes for constructing the device 10 in accordance with the present invention based upon the teachings of the present disclosure.

The ball receiving means 11 is formed of a generally cup shaped configuration and includes front and rear walls 16 and 17 respectively, opposite sidewalls 18 and 19, a bottom wall 20 and an open top 21. The rear wall 16 has a forwardly extending arcuate upper portion **16*a* that extends over the open top 21. As shown best in FIG. 1, the upper portion of the front wall 16 preferably is formed with a notched portion 22** for a purpose described below.

Figure 2:
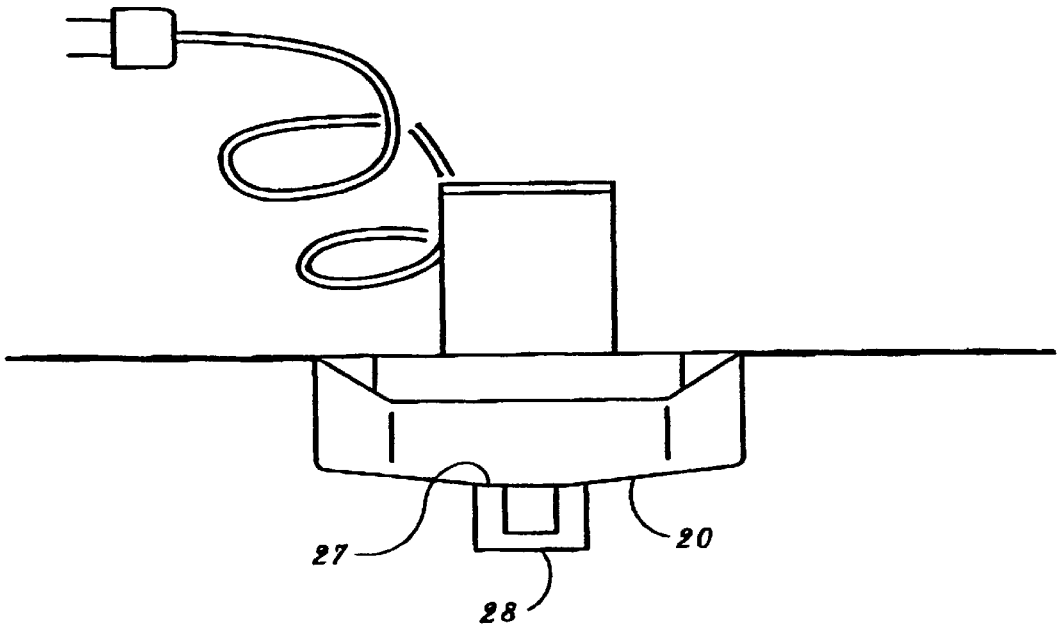
FIG. 2 is a cross-sectional view taken along the line 2—2 of FIG. 1 and showing a ball return mechanism included in the invention.
Figure 9:
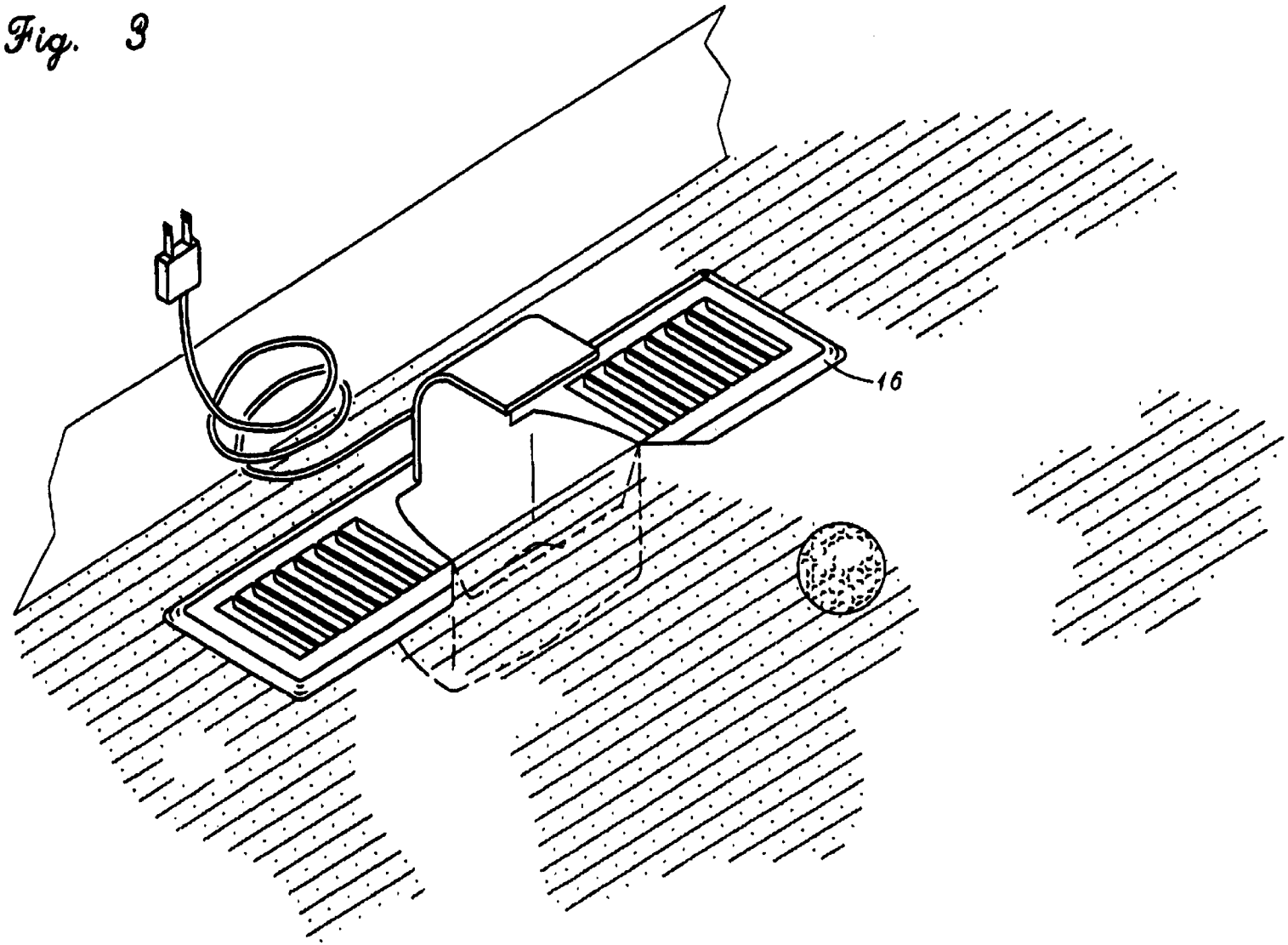
Figure 4:
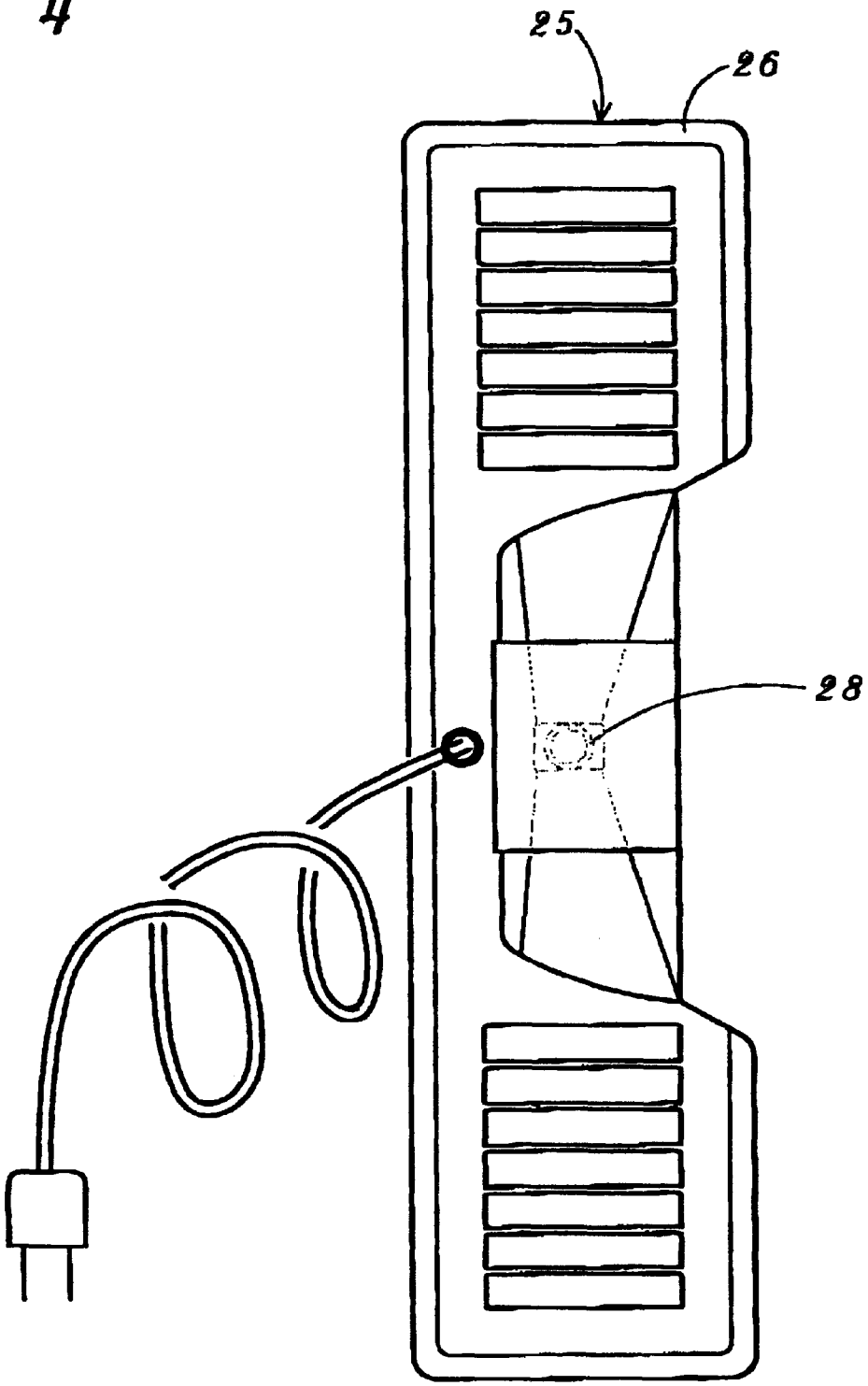
FIG. 4 is a plan view of the putting practice device of FIG. 1.

As can also be seen from FIG. 2, the receiving means bottom wall 20 is generally V-shaped to cause any golf ball putted into the means 11 to move to the center portion 27 of the wall 20. Positioned in such center portion 27 is a ball return mechanism 28 for ejecting a golf ball out of the receiving means 11.

The mechanism 28 is well known in the prior art and is available in various designs. Preferably, the mechanism 28 has a solenoid that is actuated by the depression of a trigger (not shown) that serves to sense when a ball is in a position to be ejected. The trigger can be operated either through visual or mechanical sensing of the presence of a ball. Upon actuation of the mechanism 28 by the trigger the ball is driven upwardly against the rear wall arcuate portion **16*a***, which directs the ball back toward the user.

Each of the support plates 12 and 13 is generally elongated and rectangular in shape, with a radius curve at each corner to prevent snagging or injury. The plates 12 and 13 extend outwardly from the upper portions of the sidewalls 18 and 19 respectively in perpendicular fashion and as shown by FIG. 2, the side plates 12 and 13 and the ball receiving means 11 are sized so that the device 10 fits within a floor duct of a forced air circulation system, as shown in FIG. 2. In the preferred embodiment, the plates 12 and 13 are of the same length so that the ball receiving means is generally centered in the device 10. However, it would be possible to vary the location of the receiving means by making the plates 12 and 13 of different lengths or to have only one of the support plates 12 and 13, thereby placing the receiving means at one end of the device 10. To hold the practice device 10 in place during operation, it may be preferably to tack it in place with 2–4 screws that will thread into the carpeting and pad, but not the underlying wood.

Preferably, the support plates 12 and 13 have a plurality of apertures 23 in parallel alignment with one another to provide for the passage of air out of the floor duct just as a standard duct vent would do. It may also be advantageous in terms of air flow to have similar type apertures in the bottom wall 20 of the ball receiving means 11. The support plates 12 and 13 together with the ball receiving means 11 form a peripheral flange 25 about the device 10 for coacting with the circumference of the floor duct to maintain the device 10 in position seated in the duct opening. The flange 25 is formed with a beveled lip 26 that not only adds rigidity to such flange, but also provides an aesthetically pleasing "finished" look to the final product.

In operation of the device 10, the user merely substitutes such device for an existing floor duct vent. In a passive manner, the device 10 functions sufficiently as would the replaced vent. When users wish to practice their putting skills, the recessed portion 22 of the front wall 16 serves as a putting target and a golf ball can roll directly into the ball receiving means 11 as a result of the notched portion 22. The ball drops down to the bottom wall 20 of the receiving means 11 to engage the ball return mechanism 28 and is returned to the user as previously described.

Although the invention has been described with respect to a preferred embodiment thereof, it is to be understood that it is not to be so limited, since changes and modifications can be made therein which are within the full intended scope of this invention as defined by the appended claims. For example, the size of the ball receiving means can be increased or reduced in size as well as its notched front wall.

What is claimed is:

1. A golf putting practice device adapted to serve as a substitute for a floor vent that fits into a floor duct of a forced air circulation system of a building, said device comprising:

(a) a cup shaped ball receiving means having a closed bottom a substantially open top, and front and rear walls;

(b) at least one flat support plate member extended outwardly from an upper portion of said ball receiving means, said plate member having a plurality of apertures for the passage of air therethrough;

(c) said rear wall comprising a generally vertical portion extending into a forwardly arcuate upper portion; and (d) a ball return means associated with said bottom of said ball receiving means for ejecting a golf ball from said receiving means via said forwardly arcuate upper portion of said rear wall.

2. The golf putting practice device as recited in claim 1, wherein the bottom of the ball receiving means is of a generally V-shaped configuration.

3. The golf putting practice device as recited in claim 2, wherein said ball return means is located in the center of the receiving means bottom.

4. The golf putting practice device of claim 1, wherein said ball receiving means further includes opposite sidewalls.

5. The golf putting practice device of claim 4, wherein said device further includes a pair of support plate members, each extended outwardly from an upper portion of one of said opposite sidewalls.

6. The golf putting practice device of claim 5, wherein said front wall of the ball receiving means has an upper notched portion that provides a golf ball open access to said ball receiving means when the device is installed into the floor duct.

7. The golf putting practice device of claim 5, wherein the support plate members and the rear wall of the ball receiving means form a peripheral flange that rests upon a circumference of said floor duct.

8. The golf putting device of claim 5, wherein said support plate members are equally sized so that when the device is fit into the floor duct, the ball receiving means is generally centered therein.

9. A golf putting practice device as recited in claim 5 wherein said ball receiving means and said support plate members are sized according to the size of the floor duct into which said device fits.

10. A golf putting practice device as recited in claim 5, wherein said plate members and the open top of said ball receiving means lie in the same plane.

11. A golf putting practice device adapted to serve as a substitute for a floor vent that fits into a floor duct of a forced air circulation system of a building, said device comprising:

a) a golf ball receiving means having a bottom, two opposing sides, a front and back side, and a substantially open top;

b) said back side comprising a generally vertical portion and a forwardly extending arcuate portion;

c) at least one flat support plate member extended outwardly from one of said opposing sides, said plate member having a plurality of apertures for the passage of air therethrough;

d) a ball return means associated with said bottom of said golf ball receiving means for ejecting said golf ball upwardly against the forwardly extending arcuate portion.

12. A golf putting practice device adapted to serve as a substitute for a floor vent that fits into a floor duct of a forced air circulation system of a building, said device comprising:

a) a golf ball receiving means having a bottom, two opposing sides, a front and back side, and a substantially open top;

b) said back side comprising a generally vertical portion and a forwardly extending arcuate portion;

c) said front side of the golf ball receiving means having an upper notched portion that provides a golf ball open access to said ball receiving means;

d) at least one flat support plate member extended outwardly from one of said opposing sides, said plate member having a plurality of apertures for the passage of air therethrough; and e) a ball return means associated with said bottom of said golf ball receiving means for ejecting said golf ball upwardly against the forwardly extending arcuate portion.

* * * * *